US008387957B2

(12) United States Patent
Johnson et al.

(10) Patent No.: US 8,387,957 B2
(45) Date of Patent: Mar. 5, 2013

(54) DOWNFLOW MIXERS WITH GAS INJECTION DEVICES AND/OR BAFFLES

(75) Inventors: Lloyd W. Johnson, Roscoe, IL (US); Kendra A. Copley, Macungie, PA (US)

(73) Assignee: Aqua-Aerobic Systems, Inc., Loves Park, IL (US)

( * ) Notice: Subject to any disclaimer, the term of this patent is extended or adjusted under 35 U.S.C. 154(b) by 628 days.

(21) Appl. No.: 12/322,100

(22) Filed: Jan. 29, 2009

(65) Prior Publication Data

US 2010/0187701 A1 Jul. 29, 2010

(51) Int. Cl.
*B01F 3/04* (2006.01)

(52) U.S. Cl. ..... 261/93; 261/123

(58) Field of Classification Search ..... 261/77, 261/93, 120, 123, 124
See application file for complete search history.

(56) References Cited

U.S. PATENT DOCUMENTS

| | | | | |
|---|---|---|---|---|
| 2,194,037 | A | | 3/1940 | Thuma |
| 2,991,983 | A | | 7/1961 | Logan |
| 3,043,433 | A | | 7/1962 | Singer |
| 3,092,678 | A | | 6/1963 | Braun |
| 3,206,176 | A | | 9/1965 | Peterson |
| 3,210,053 | A | | 10/1965 | Boester |
| 3,439,807 | A | | 4/1969 | Danjes |
| 3,452,966 | A | | 7/1969 | Smolski |
| 3,643,403 | A | * | 2/1972 | Speece ..... 95/265 |
| 3,666,103 | A | | 5/1972 | Green |
| 3,827,679 | A | | 8/1974 | Kaelin |
| 3,865,721 | A | | 2/1975 | Kaelin |
| 4,045,336 | A | | 8/1977 | Isteri |
| 4,051,204 | A | * | 9/1977 | Muller et al. ..... 261/36.1 |
| 4,086,306 | A | | 4/1978 | Yoshinaga |
| 4,136,023 | A | | 1/1979 | Kirk |
| 4,192,740 | A | | 3/1980 | Savard |
| 4,256,839 | A | | 3/1981 | Solomons |
| 4,263,143 | A | | 4/1981 | Ebner |
| 4,337,152 | A | * | 6/1982 | Lynch ..... 210/197 |
| 4,422,771 | A | | 12/1983 | Earhart |
| 4,454,077 | A | | 6/1984 | Litz |
| 4,455,232 | A | | 6/1984 | Reid |
| 4,477,341 | A | * | 10/1984 | Schweiss et al. ..... 209/170 |
| 4,512,936 | A | * | 4/1985 | Oshima et al. ..... 261/93 |
| 4,585,555 | A | * | 4/1986 | Reid ..... 210/194 |
| 4,723,848 | A | | 2/1988 | Knight |
| 4,733,972 | A | | 3/1988 | Weis |
| 4,734,197 | A | * | 3/1988 | Reid ..... 210/629 |
| 4,764,053 | A | | 8/1988 | Schupbach |
| 4,919,849 | A | | 4/1990 | Litz |
| 4,956,100 | A | | 9/1990 | Mikkleson |
| 4,997,557 | A | | 3/1991 | Andersen |
| 5,009,816 | A | | 4/1991 | Weise |
| 5,021,154 | A | | 6/1991 | Haegeman |
| 5,371,283 | A | | 12/1994 | Kingsley |

(Continued)

FOREIGN PATENT DOCUMENTS

| | | |
|---|---|---|
| FR | 2798602 | 3/2001 |
| JP | 1258732 | 10/1989 |

(Continued)

*Primary Examiner* — Charles Bushey
(74) *Attorney, Agent, or Firm* — Niro, Haller & Niro

(57) ABSTRACT

A downflow mixer with a gas injection device and/or a baffle plate is provided to improve performance of mixing and/or aeration in basins, lagoons or tanks, particularly as part of water or wastewater treatment.

14 Claims, 3 Drawing Sheets

U.S. PATENT DOCUMENTS

| | | | | |
|---|---|---|---|---|
| 5,451,348 | A | 9/1995 | Kingsley | |
| 5,454,986 | A | 10/1995 | Lessen | |
| 5,851,066 | A | 12/1998 | Nocifora | |
| 5,874,003 | A | 2/1999 | Rose | |
| 5,916,491 | A | 6/1999 | Hills | |
| 5,925,290 | A | 7/1999 | Hills | |
| 5,941,682 | A | 8/1999 | Cybularz | |
| 6,123,446 | A | 9/2000 | Schuchardt | |
| 6,135,430 | A | 10/2000 | Bergman, Jr. | |
| 6,145,815 | A | 11/2000 | Cheng | |
| 6,245,237 | B1 | 6/2001 | Blough | |
| 6,270,061 | B1 | 8/2001 | Bouquet | |
| 6,461,500 | B1 | 10/2002 | Hoage | |
| 6,464,384 | B2 | 10/2002 | Kubera | |
| 6,761,797 | B2 | 7/2004 | Kohlgruber | |
| 6,863,817 | B2 | 3/2005 | Liu | |
| 6,971,843 | B2 * | 12/2005 | Desy et al. | 415/116 |
| 7,329,351 | B2 | 2/2008 | Roberts | |
| 7,413,656 | B2 | 8/2008 | Allen | |
| 7,455,776 | B2 | 11/2008 | Fabiyi | |
| 7,497,949 | B2 | 3/2009 | Fabiyi | |
| 2004/0007523 | A1 | 1/2004 | Gabon | |
| 2004/0050764 | A1 | 3/2004 | Perriello | |
| 2005/0258094 | A1 | 11/2005 | Chiba | |
| 2005/0280167 | A1 | 12/2005 | Hills | |
| 2006/0255482 | A1 | 11/2006 | Chevalier | |
| 2007/0290380 | A1 | 12/2007 | Avrillier | |
| 2008/0237108 | A1 * | 10/2008 | Hall | 210/192 |
| 2009/0075364 | A1 | 3/2009 | Fabiyi | |

FOREIGN PATENT DOCUMENTS

| | | | |
|---|---|---|---|
| WO | WO2005-099880 | A1 | 10/2005 |

* cited by examiner

DOWNFLOW MIXERS WITH GAS INJECTION DEVICES AND/OR BAFFLES

BACKGROUND OF THE INVENTION

The present inventions relate to mixers. More particularly, the present inventions relate to mixers that are equipped with gas injection devices and/or baffle plates to improve mixing in a variety of applications, including but not limited to water and wastewater treatment applications.

There are numerous available mixers for water and wastewater treatment applications. Of particular applicability to the present inventions are floating vertical shaft downflow mixers. Typical devices are shown and described in U.S. Pat. Nos. 4,723,848; 4,442,771 and 2,991,983 (all incorporated herein by reference). In general, such mixers include an annular float to support the mixer on the body of fluid to be mixed. A drive motor is mounted on the top of the float above the surface of the fluid. A propeller or drive shaft is connected to the drive motor and extends downwardly therefrom below the float and into the fluid. A propeller or impeller is attached to the drive shaft. A draft tube is typically mounted to the underside of the float extending downward from the float which encases the propeller. The draft tube is also provided with an intake at its upper end which is near the bottom of the float and a lower end that forms a discharge. When in use, operation of the propeller causes the fluid to be drawn into the intake in a pumping action. The fluid is then forced through the draft tube discharge end to mix the bulk fluid contents.

Other types of mixers are also known, including those that inject oxygen or other gases into the fluid body. Some such devices are shown and described in U.S. Pat. Nos. 6,145,815; 6,135,430 and EP0252903. Such known devices that inject gas as part of the mixing process typically include hoods and other mechanical arrangements that are more complicated and expensive than typical downflow mixers.

There is a need to improve the performance of typical downflow mixers, as well as to incorporate gas injection capabilities into such mixers. The present inventions are directed to such needs. In fact, the present inventions have led to unexpected results in their various combinations.

SUMMARY OF THE INVENTION

The present inventions preserve the advantages of known downflow and other mixers and also provide new features, advantages and results.

Therefore, it is an object of the present invention to provide a downflow mixer that improves mixing performance using a baffle plate.

Another object of the present invention is to incorporate a gas injection device on a downflow mixer to improve mixing performance.

Still another object of the present invention is to provide a downflow mixer with a gas injection device and a baffle to increase mixing performance.

A further object of the present invention is to provide a gas injection device that may be easily turned on or off as desired.

An additional object of the present invention is to provide a gas injected downflow mixer wherein the injection of gas does not decrease the pumping efficiency of the mixer and provides increased mixing capabilities.

Accordingly, the present inventions provide a gas injected downflow mixer having a draft tube with a lower discharge end and a gas source. A gas injection device is also provided which is attached to the lower discharge end of the draft tube. The gas injection device includes an injector body having injection ports, a gas distribution manifold attached to the injector body to distribute the gas to the injection ports, and at least one gas inlet port to provide a gas supply to the gas distribution manifold. A baffle plate may also be attached to a lower end of the injector body to keep gas bubbles from short circuiting the mixer intake. In addition, baffles or preferably v-shaped baffles may be placed on the inside of the injector body above one or more of the injection ports to create low or negative pressure around the injection ports. Flow disruptors may also be located on the interior of the injector body to increase shear.

The present inventions also provide a downflow mixer having a draft tube with a lower end defining a discharge end and a baffle plate attached to said discharge end which extends horizontally from said discharge end to prevent gas bubbles from interfering with pumping or mixing efficiency and to induce proper mixing flow.

The present inventions further provide a floating fluid mixer having a draft tube with a lower end submerged in the fluid to be mixed and a gas injection device with a discharge end attached to the lower end of the draft tube. The gas injection device includes an injector body having an interior and an exterior, injection ports in the injector body to distribute the gas and a gas distribution manifold attached to the injector body to distribute the gas to the injection ports. The interior of the injector body is provided with baffles over one or more of the injection ports. And, a baffle plate may be attached to the discharge end of the gas injection device. Flow disruptors may also be provided on the interior of the injector body.

INVENTOR'S DEFINITION OF THE TERMS

The terms used in the claims of this patent are intended to have their broadest meaning consistent with the requirements of law. Where alternative meanings are possible, the broadest meaning is intended. All words used in the claims are intended to be used in the normal, customary usage of grammar and the English language.

BRIEF DESCRIPTION OF THE DRAWINGS

The stated and unstated objects, features and advantages of the present inventions (sometimes used in the singular, but not excluding the plural) will become apparent from the following descriptions and drawings, wherein like reference numerals represent like elements in the various views, and in which.

DETAILED DESCRIPTION OF PREFERRED EMBODIMENTS

Set forth below is a description of what is currently believed to be the preferred embodiments or best representative examples of the inventions claimed. Future and present alternatives and modifications to the embodiments and preferred embodiments are contemplated. Any alternatives or modifications which make insubstantial changes in function, purpose, structure or result are intended to be covered by the claims of this patent.

The present inventions have particular applicability to vertical shaft downflow mixers, including unidirectional and multidirectional mixing devices. It will be understood by those of skill in the art that the present inventions may be used with different types of mixers, including those with and without floats. For discussion purposes, the present inventions are described when used in conjunction with an AquaDDM® direct drive mixer/blender available from Aqua-Aerobic Systems, Inc. of Rockford, Ill. USA, which is preferred. In addition, the preferred gas supply system for the gas injection device is the Vacuum Swing Absorption ("VSA") unit manufactured and sold by Air Products and Chemicals, Inc. of Allentown, Pa. USA. It will also be understood that other gas supply systems may be used in the present inventions.

Figure 1:
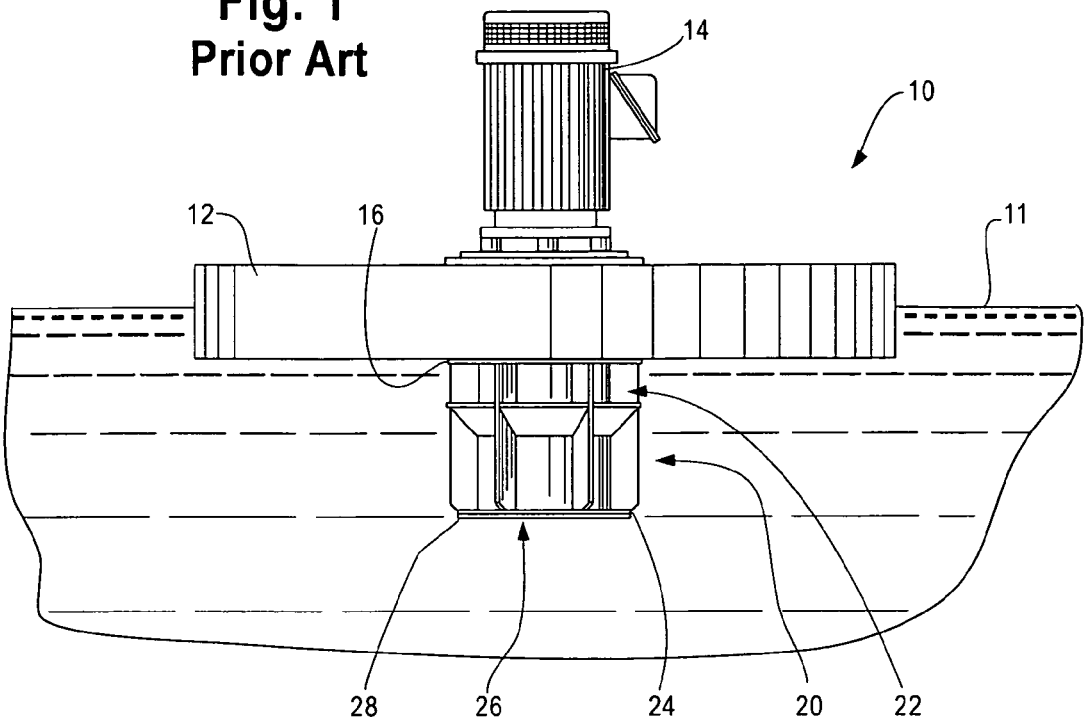
Fig. 1 Prior Art
FIG. 1 is a side view of a typical vertical shaft downflow mixer known in the prior art.

In FIG. 1, a typical downflow mixer is shown generally as 10. Mixer 10 includes an annular float 12 which supports the mixer 10 on the surface of the fluid 11 to be mixed. A drive motor 14 is provided and mounted to float 12 by well known means. A drive shaft (not shown) is connected to the drive motor 14. Drive shaft (not shown) extends downwardly from drive motor 14 and terminates in a propeller (not shown). A draft tube or volute 20 is provided on the underside of float 12 and may extend through float 12, as will be understood by those of ordinary skill in the art (see generally U.S. Pat. No. 4,422,771). The upper end 16 of draft tube 20 is provided with an intake 22. The lower end 24 of draft tube 20 encases a propeller and terminates at a discharge end 26. A lower attachment flange 28 may also be provided. In operation, because of the action of the propeller, the fluid to be mixed enters intake 22 and is discharged out of discharge end 26 to effectuate mixing in the fluid tank or basin (not shown). In the preferred embodiment, the present inventions are attached to discharge end 26 of draft tube 20 using attachment flange 28.

Figure 2:
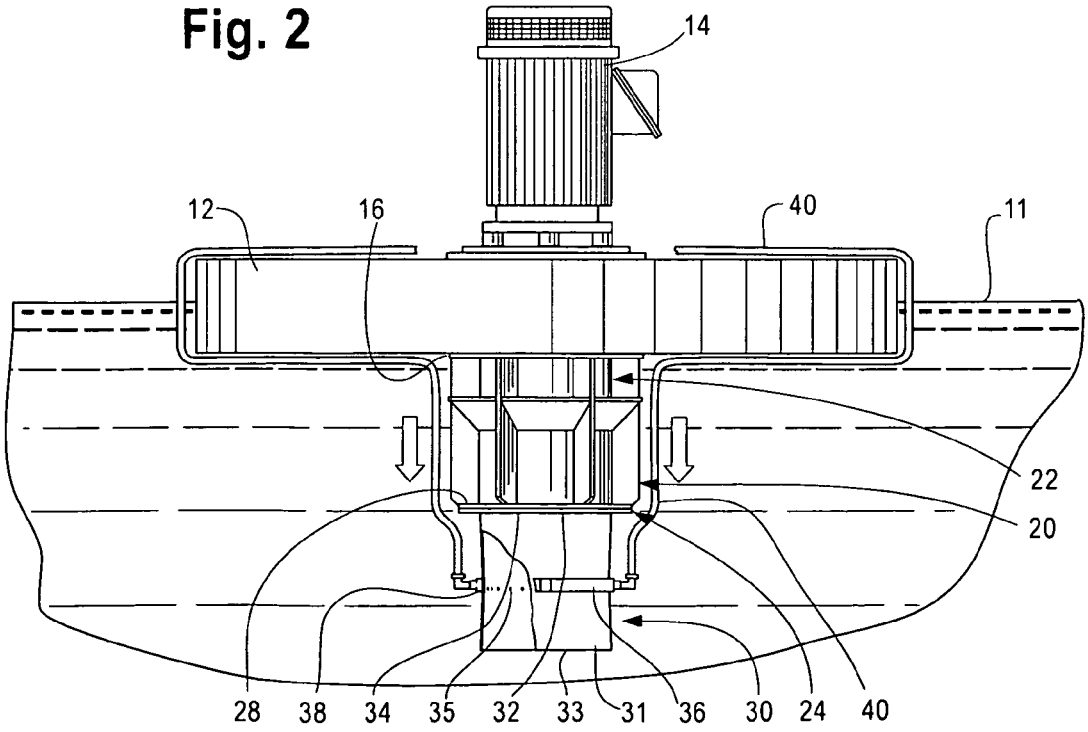
FIG. 2 is a side view of a typical downflow mixer including a preferred embodiment of a gas injection device of the present invention, with portions of the preferred gas injection device cut away to show detail.
Figure 3:
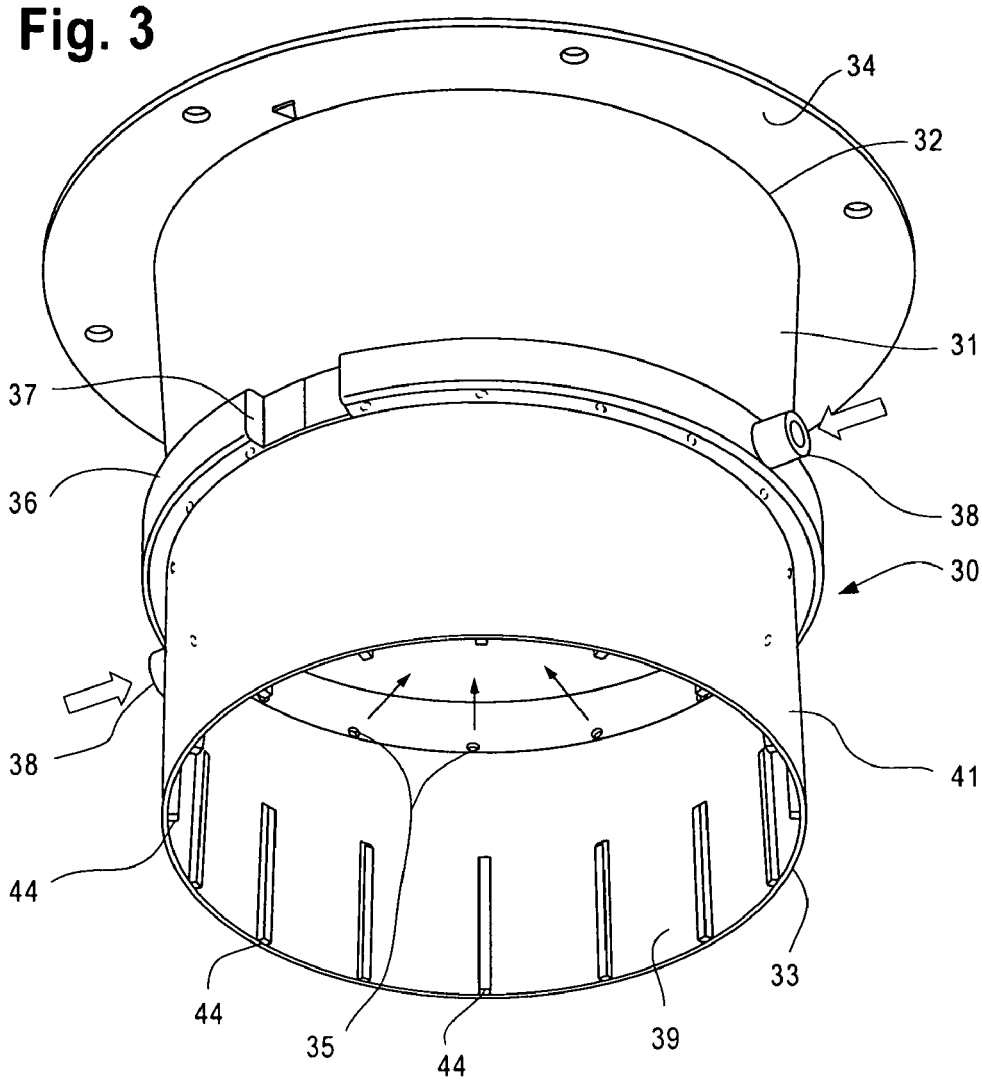
FIG. 3 is a perspective view of a preferred embodiment of a gas injection device of the present invention.
Figure 4:
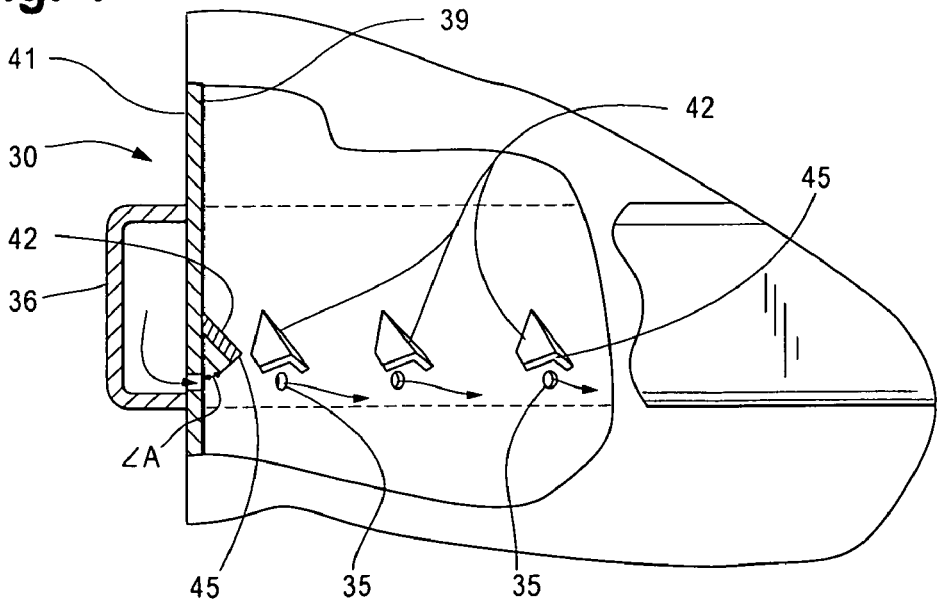
FIG. 4 is a detailed cut-away view of the embodiment of FIG. 2 showing a preferred gas distribution manifold and preferred v-shaped baffles of the present invention.
Figure 5:
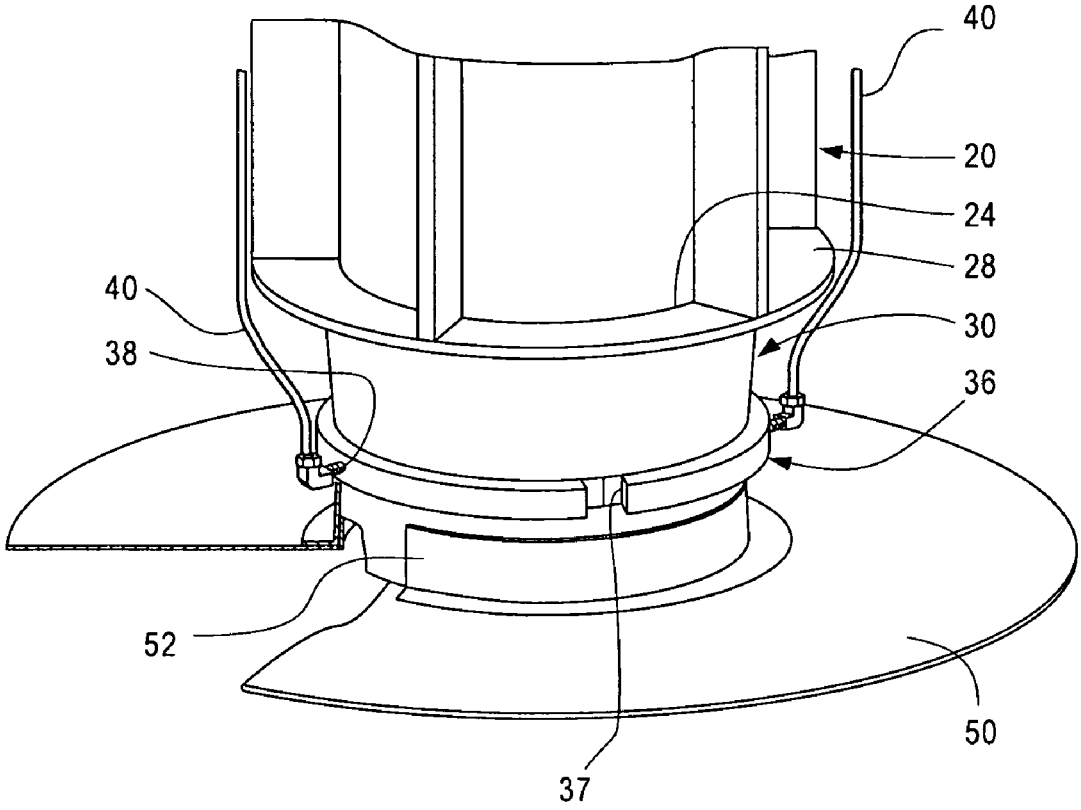
FIG. 5 is a perspective view of a preferred gas injection device and a preferred embodiment of a flow baffle or baffle plate of the present inventions, with portions cut away to show detail of a preferred v-shaped baffle; and, FIG. 6 is a perspective view of a preferred embodiment of a baffle plate of the present invention shown incorporated on a typical downflow mixer such as shown in FIG. 1.
Figure 6:
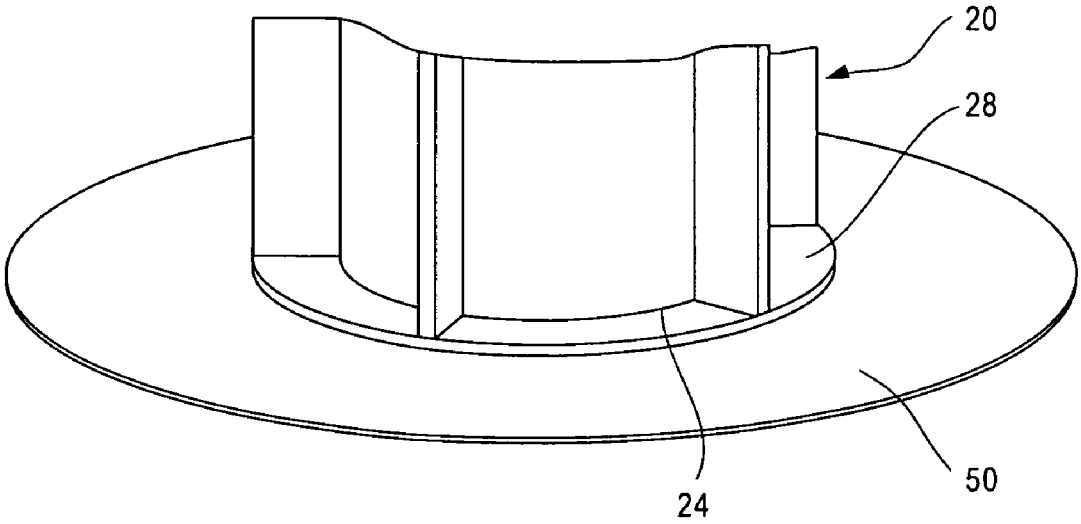

Preferred and exemplary embodiments of the present inventions may best be seen by reference to FIGS. 2-6. FIG. 2 shows a preferred embodiment of a gas injection device 30 without incorporation of a preferred baffle plate 50 of the present invention. FIG. 5 shows preferred gas injection device 30 used in conjunction with a preferred baffle plate 50. FIG. 6 shows a preferred baffle plate 50 without a preferred gas injection device 30. And, FIGS. 3 and 4 show details of a preferred embodiment of gas injection device 30. It will be understood by those of skill in the art that the present inventions may be used with other types of mixers and/or aerators or the like, and may be used in lagoons, basins or tanks.

A preferred gas injection device 30 is shown in FIGS. 2-5. Preferably, gas injection device 30 includes an injector body 31 having an interior 39 and an exterior 41, as well as a top end 32 and bottom end 33. It will be understood by those of skill in the art that the shape of injector body 31 of gas injection device 30 does not have to be cylindrical. It is preferred, however, that the shape of the injector body 31 properly mate with and/or compliment draft tube 20 of mixer 10. Top end 32 of injector body 31 is provided with a flange 34. Flange 34 is designed to mate with a complimentary lower attachment flange 28 on discharge end 26 of draft tube 20, and may be attached thereto by welding, bolts or other well known means (attachment means not shown). The length of the injector body 31 of the gas injection device 30 varies depending upon the particular mixer used and the specific application.

Injector body 31 is provided with a series of injection ports 35 spaced around its circumference. In the preferred embodiment, the injection ports 35 are placed between one-half and two-thirds of the way down from the top 32 of injector body 31. It has been found that if the injection ports 35 are too close to the propeller or impeller, the gas bubbles injected will rise to the propeller and will interfere with the proper pumping performance and efficiency. At the preferred placement along the length of injector body 31, the flow of pumped fluid is sufficient to carry away the gas bubbles. In fact, those of skill in the art may find it counter-intuitive to add a gas injector to a pump/mixer because of the potential loss of pumping or mixing power potentially caused by the gas bubbles. Injection ports 35 are designed and sized to permit the passage of oxygen or other gas into the fluid stream. It will be understood by those of ordinary skill in the art that the diameter of injection ports 35 will vary based upon the capability of the oxygen or other gas delivery system such as the preferred VSA unit. In the preferred embodiment, the maximum diameter of injection port 35 was one-eight inch, which helps prevent backflow into the gas injection device 30. Injector body 31 may be tapered or otherwise modified depending upon the flow characteristics desired. It is preferred, however, that injector body 31 not be tapered.

Covering and in fluid communication with injection ports 35 is a gas distribution manifold 36 mounted to or on the exterior 41 of the injector body 31. In the preferred embodiment, manifold 36 is generally a u-shaped channel that is welded or otherwise secured to the exterior 41 of injector body 31 and covers injection ports 35. In the preferred embodiment, manifold 36 is in two pieces to essentially ring the entire circumference of injection ports 35 around injector body 31. As a result, end caps 37 are provided to make manifold 36 air tight. It will be understood by those of ordinary skill in the art that manifold 36 may take a variety of shapes sufficient to distribute the gas to be injected through injection ports 35 in a uniform manner. In a preferred embodiment, a gas inlet port 38 is provided for each half of manifold 36. Gas inlet port 38 is in fluid communication with the interior of manifold 36. Gas inlet port 38 is then connected to gas line 40 (FIGS. 2 and 5) which is connected to a gas source (not shown), such as the preferred VSA unit.

Also in a preferred embodiment, a series of v-shaped baffles 42 is provided over each injection port 35 on the interior 39 of injector body 31. In a preferred embodiment, baffles 42 are fabricated from structural angles and secured by well known means such as welding to the interior 39 of injector body 31 to overhang injection ports 35. As shown in FIG. 4, the preferred angle A of baffle 42 and the interior 39 of injector body 31 is 60°.

One purpose of baffles 42 is to increase turbulence around injection ports 35 that aids in proper bubble formation. Another purpose is to create low or negative pressure at or around injection ports 35. It has been found that the highest area low pressure is at the apex or top 45 of baffle 42 (see FIG. 4). Thus, in the preferred embodiment, baffle 42 is located above injection ports 35 so that the top or apex 45 is approximately aligned with injection ports 35. The creation of these low pressure zones is desirable to prevent clogging of injection ports 35 or backflow of fluid in injection ports 35 because of submergence and/or fluid motion. For example, in some settings, it is desirable to turn gas injection on and off depending upon the treatment or process steps. The presence of baffles 42 prevent clogging or backflow.

In addition, baffles 42 help induce gas flow so that the delivery system does not have to overcome entry pressure upon start-up and operates more efficiently. Thus, the present inventions obviate the need for complicated and expensive valve systems and the like. Finally, a series of flow disruptors 44 may also be provided at the lower end 33 on the interior 39 of injector body 31. The optional flow disruptors 44 help increase shear and break-up the gas bubbles for better mixing.

By reference to FIGS. 5 and 6, yet another novel aspect of the preferred inventions may be seen. Specifically, FIG. 5 shows a preferred baffle plate 50 attached to the lower end 33 of gas injection device 30. It will be understood that baffle plate 50 may be welded, bolted or otherwise secured to draft tube 20. An example using a flange 52 is shown in FIG. 5. FIG. 6 shows a preferred embodiment of baffle plate 50 attached to the end of draft tube 20 of a typical downflow mixer 10. In this embodiment, baffle plate 50 may be bolted or welded to lower attachment flange 28 by bolts, welding or other well known means. Baffle plate 50 is useful when it is desired to limit the gas bubbles from rising back into the influent 22 and affect pumping action. When that "short circuit" occurs, the bubbles flood the propeller and reduce pumping capacity. The use of baffle plate 50 also provided unexpected results. For example, the use of baffle plate 50 resulted in a different and improved mixing pattern in the basin, tank or lagoon which was found to increase gas transfer by approximately 5%. In addition, baffle plate 50 permits the gas/fluid mixture to travel deeper into the tank or basin, and increases the toroidal mixing pattern. It is preferred that baffle plate 50 be large enough to prevent a "short circuit," but not be too large that it negatively affects the rolling or toroidal motion of the mixing fluid.

The above description is not intended to limit the meaning of the words used in or the scope of the following claims that define the invention. Rather, it is contemplated that future modifications in structure, function or result will exist that are not substantial changes and that all such insubstantial changes in what is claimed are intended to be covered by the claims. Thus, while preferred embodiments of the present inventions have been illustrated and described, it will be understood that changes and modifications can be made without departing from the claimed invention. In addition, although the term "claimed invention" or "present invention" is sometimes used herein in the singular, it will be understood that there are a plurality of inventions as described and claimed.

Various features of the present inventions are set forth in the following claims.

What is claimed is:

1. A gas injected downflow mixer for use in a tank or basin for containing a fluid, said mixer having a draft tube with an upper end having a fluid intake and with an unobstructed lower end below the upper end forming a discharge end, comprising;

a propeller or impeller housed within said draft tube between said fluid intake and said discharge end;

a gas source;

a gas injection device attached to said unobstructed lower discharge end of said draft tube below said propeller or impeller, said gas injection device including an injector body having injection ports below said propeller or impeller and discrete flow disruptors along a lower end of the injector body, a gas distribution manifold attached to said injector body to distribute said gas to said injection ports, and at least one gas inlet port to supply said gas to said manifold from said gas source wherein said fund contained in said tank or basin is mixed by said mixer.

2. A gas injected down/low mixer having a draft tube with an upper having a fluid intake and with an unobstructed lower end below the upper end forming a discharge end, comprising:

a propeller or impeller housed within said tube between said fluid intake and said discharge end;

a gas source;

a gas injection device attached to said unobstructed lower discharge end of said draft tube below said propeller or impeller, said gas injection device including an injector body having an unobstructed lower end, injection ports below said propeller or impeller, a gas distribution manifold attached to said injector body to distribute said gas to said injection ports, at least one gas inlet port to supply said gas to said manifold from said gas source; and a baffle plate is attached to said unobstructed lower end of said injector body and below said propeller or impeller to prevent short circuiting.

3. The downflow mixer of claim 2 wherein at least one gas line is provided in fluid communication with said at least one gas inlet port.

4. The gas injected downflow mixer of claim 2 wherein said injection, ports are spaced around a circumference of said injector body.

5. The gas injected downflow mixer of claim 2 wherein baffles are provided above each of said injection ports on an interior of the injector body.

6. The gas injected downflow mixer of claim 5 wherein said baffles are v-shaped.

7. The gas injected downflow mixer of claim 2 wherein discrete flow disruptors are provided along the lower end of said injector body on the interior of said injector body and below said propeller or impeller and below said gas injection ports.

8. A downflow mixer having a draft tube, said draft tube having an unobstructed lower end which serves as a discharge end, comprising:

a baffle plate attached to said unobstructed lower end wherein said baffle plate extends at least fifty percent of the diameter of the draft tube horizontally from said discharge end to prevent short circuiting and to improve mixing.

9. The downflow mixer of claim 8 wherein said baffle plate is circular.

10. A fluid mixer having a draft tube with an upper end having a fluid intake and a lower end forming an unobstructed discharge end which is submerged in a fluid to be mixed, comprising a propeller or impeller housed within said than tube between said fluid intake and said unobstructed discharge end for pushing said fluid through said discharge end;

a gas injection device with a discharge end attached to said lower end of said draft tube below said propeller or impeller including an injector body having an interior and exterior, said interior including injection ports below said propeller or impeller in the injector body, and a gas distribution manifold on the exterior of said draft tube to distribute said gas to said injection ports;

baffles located on said injector body above each of said injection ports on the interior of said injector body; and, a baffle plate attached near said unobstructed discharge end of said gas injection device which extends radially outward from said discharge end to prevent short circuiting.

11. The downflow mixer of claim 10 wherein flow disruptors are pined on the interior of the draft tube below said gas injection ports.

12. The downflow mixer of claim 10 wherein said injector body is tapered.

13. The downflow mixer of claim 10 wherein said gas distribution manifold is a circular ring having a u-shaped channel and a gas inlet port to provide gas from a as source to said gas distribution manifold.

14. The gas injection downflow mixer of claim 6 wherein the apex of the v-shaped baffles is substantially aligned with said injection ports.

* * * * *

UNITED STATES PATENT AND TRADEMARK OFFICE

CERTIFICATE OF CORRECTION

PATENT NO. : 8,387,957 B2
APPLICATION NO. : 12/322100
DATED : March 5, 2013
INVENTOR(S) : Johnson et al.

It is certified that error appears in the above-identified patent and that said Letters Patent is hereby corrected as shown below:

In the Specifications

Col. 6, line 2, “fund” should read --fluid--

Col. 6, line 4, “down/low” should read --downflow--

Col. 6, line 5, “upper having” should read --upper end having--

Col. 6, line 8, “said tube” should read --said draft tube--

Col. 6, line 52, “than” should read --draft--

Col. 7, line 2, “pined” should read --placed--

Col. 8, line 1, “a as” should read --a gas--

Signed and Sealed this
Twenty-third Day of April, 2013

Teresa Stanek Rea
*Acting Director of the United States Patent and Trademark Office*